United States Patent [19]

Szabo

[11] 4,456,246

[45] Jun. 26, 1984

[54] WEIGHT LIFTING EXERCISING APPARATUS

[76] Inventor: William Szabo, 10126 Langmoir Ave., Sunland, Calif. 91040

[21] Appl. No.: 362,168

[22] Filed: Mar. 26, 1982

Related U.S. Application Data

[63] Continuation-in-part of Ser. No. 166,077, Jul. 7, 1980, Pat. No. 4,346,888.

[51] Int. Cl.[3] ..... A63B 21/06

[52] U.S. Cl. ..... 272/118

[58] Field of Search ..... 272/117, 118, 134, 144, 272/123

[56] References Cited

U.S. PATENT DOCUMENTS

| | | | |
|---|---|---|---|
| 2,855,199 | 10/1958 | Noland et al. | 272/117 |
| 3,010,720 | 11/1961 | Allard | 272/117 |
| 3,189,347 | 6/1965 | Dodge | 272/117 |
| 3,820,782 | 6/1974 | Salkeld | 272/118 |
| 3,840,227 | 10/1974 | Chesemore | 272/118 |
| 3,866,914 | 2/1975 | Jackson | 272/117 X |
| 3,912,263 | 10/1975 | Yatso | 272/118 |
| 4,317,566 | 3/1982 | Uyeda et al. | 272/118 |
| 4,339,125 | 7/1982 | Uyeda et al. | 272/118 |

*Primary Examiner*—Richard J. Apley
*Assistant Examiner*—Chris Coppens
*Attorney, Agent, or Firm*—Robert J. Schaap

[57] ABSTRACT

A weight lifting body exercising apparatus which includes an upstanding frame having a single upstanding pole-like member for supporting a vertically shiftable carriage. The carriage is adapted to receive weights as, for example, bar-bell type weights. The carriage is mounted on the pole-like member in such manner that only a very small amount of binding or frictional force is created through movement of the carriage. A body supporting bench is adapted to be removably attached to the frame in a plurality of positions so that the bench can be located at various angles and at various heights relative to the frame and the user thereof.

18 Claims, 14 Drawing Figures

WEIGHT LIFTING EXERCISING APPARATUS

RELATED APPLICATION

This application is a continuation-in-part of my copending application Ser. No. 166,077, filed July 7, 1980 entitled "Weight-Lifting Exercising Apparatus" now U.S. Pat. No. 4,346,888.

BACKGROUND OF THE INVENTION

1. Field of the Invention

This invention relates in general to certain new and useful improvements in weight lifting exercising apparatus, and more particularly to weight lifting apparatus with a frame and a carriage vertically shiftable on said frame and capable of carrying a selected amount of bar-bell type weights thereon, and with a body supporting bench selectively attachable to said frame in a number of desired orientations to thereby enable performance of a large number of exercises.

2. Brief Description of the Prior Art

In recent years, with increased emphasis on body health, there has been an introduction into the market place, a large number of weight lifting exercising apparatus. In many cases, these weight lifting exercising apparatus have become quite sophisticated. In most constructions, the weight lifting exercising apparatus is comprised of an upstanding frame, one or more weights which may be selectively introduced and a cable connected to the weights and trained around one or more pulleys on the frame. The user of the apparatus engages the cable or some member connected to the cable, e.g. a handle and pulls on the cable to attempt to lift the selectively introduced weights.

While many of these apparatus have been very effective in enabling one to perform certain standard body exercises by lifting weights in a limited number of body positions, the exercising apparatus are not highly effective in permitting the user to perform a large number of differing exercises. Moreover, each of the commercially available exercising apparatus are constructed so that they are relatively expensive and thus, not easily affordable for home use. The same holds true in that the commercially available exercising apparatus which are available to commercial institutions are also constructed in a manner where they are not sized and conveniently operated in a home use environment.

U.S. Pat. No. Re. 28,066 to Marcyan discloses a single station body exercising apparatus which is comprised of a plurality of pulleys and a means for introducing a desired amount of weight to lift against. Moreover, a cable is trained around the pulleys and a handle mechanism for the user to engage. U.S. Pat. No. 3,438,627 to La Lanne also discloses a weight lifting apparatus in which a cable is trained around a plurality of pulleys and connected to one or more weights. The other end of the cable is provided with a handle for the user to engage and to apply a force in order to lift the weights. U.S. Pat. No. 3,912,263 to Yatso and U.S. Patent No. 3,971,555 to Mahnke disclose similar forms of body exercising apparatus. The same holds true with the body exercising apparatus taught in British Pat. No. 1,438,466 and French Pat. No. 1,444,865.

This is not a significant problem in commercial institutions, such as gymnasiums and the like, where a number of people will simultaneously use different exercising apparatus to perform various different weight lifting exercises. However, for home use, it is impractical to have a plurality of different exercising apparatus.

Another one of the problems with the commercially available exercising apparatus is the fact that most of the apparatus are constructed from structural metals, such as steel and the like. As a result, these apparatus are usually of a welded construction and not readily and easily transportable. They are quite heavy and bulky and therefore costly to ship. Moreover, by virtue of their construction they are not readily adaptable for easy assembly or disassembly.

OBJECTS OF THE INVENTION

It is, therefore, a primary object of the present invention to provide a weight lifting body exercising apparatus comprised of a main frame having as an upstanding generally vertically disposed structure, a single pole-like member, and a carriage, mounted for vertically shiftable movement on the polelike member in such manner that only a very small amount of binding or frictional force is created through the movement of the carriage, and which thereby permits the user to apply a force with respect to the carriage against substantially only a weight which is loaded on the carriage.

It is another object of the present invention to provide a weight lifting body exercising apparatus of the type stated in which the carriage is provided with a weight retaining means to receive bar-bell weight discs such that a number of differing weight discs can be removably disposed on this weight retaining means.

It is a further object of the present invention to provide for the mounting of the carriage on the single upstanding pole-like member with first and second pairs of rollers located on opposite sides of the pole-like member.

It is an additional object of the present invention to provide a weight-lifting body exercising apparatus of the type stated which comprises a body supporting bench capable of being removably attached to the upstanding frame in such a manner that various angles and various positions can be assumed with the bench for performing various types of weight lifting exercises.

It is another salient object of the present invention to provide a weight lifting body exercising apparatus which can be sold in components for easy and simply assembly for home site use.

It is still a further object of the present invention to provide a weight lifting body exercising apparatus of the type stated which is constructed so that it can occupy a small amount of space and is therefore highly suitable for home use environments, but which can also be constructed for institutional use.

With the above and other objects in view, my invention resides in the novel features of form, construction, arrangement, and combination of parts presently described and pointed out in the claims.

BRIEF SUMMARY OF THE DISCLOSURE

A weight lifting body exercising apparatus comprising a main frame which has a base portion and as an upstanding generally vertically disposed frame structure only a single polelike member. This pole-like member is mounted with respect to the base means or otherwise with respect to a wall or other supporting member in such a manner that it is stabilized against forces which would cause movement away from a generally vertical direction.

A carriage is vertically shiftable along this polelike member. A means is associated with the carriage for engagement by a user to apply a force against that imposed by one or more weights which create a load on the carriage. The carriage is mounted in such a manner that only a small amount of binding or frictional force is created through movement of the carriage. In this way, the user is permitted to apply a force with respect to the carriage against substantially only that amount of weight which is attached to the carriage and which creates a load on the carriage. In other words, little or no additional force is required by the user to overcome the effects of binding or frictional load.

The means which creates a force or so-called "load" imposed on the carriage is typically one or more barbell weight discs. A pair of rod-like members extend outwardly from opposite sides of the carriage. These weight discs are capable of being removably disposed on the outwardly extending rods and selectively interchanged in order to create the desired amount of weight on the carriage and hence, the amount of force which the user is required to apply in order to lift the carriage, or otherwise cause movement thereof.

An engageable means, in the form of a hand engageable member, is mounted on the carriage for engagement by the hands of the user. Furthermore, an adjustable positioning means carries the hand engageable means so that it can be selectively positioned on the carriage to accommodate different sized users or to accommodate an individual desiring to perform various types of weight lifting exercises.

In another aspect of the invention, a body supporting bench is provided with the apparatus and is capable of being removeably attached to the upstanding frame. In this case, the attachment means is adapted so that it can be attached to the frame in order to perform certain exercises when the bench is employed and easily and quickly removed therefrom when other exercises not requiring the bench are to be performed.

The attachement means is constructed so that the bench can be removeably attached to the frame in a generally horizontally disposed position, or somewhat horizontally disposed position, at a plurality of elevations for performing certain exercises. In addition, the attachment means is constructed so that the bench can be connected to the upstanding frame at a variety of angles in order to permit various forms of weight lifting exercises to be performed. The bench itself is preferably provided with telescopically adjustable legs.

The carriage is vertically shiftable along the polelike member through a first pair of horizontally spaced apart rollers located between the pole-like member and carriage, and a second pair of horizontally spaced apart rollers which is located below and on opposite sides of the carriage with respect to the first set of rollers and provides a bearing action for the carriage when pulled in one direction. A third set of rollers located rearwardly of the first set on the upper rear portion of the carriage and a fourth set of rollers located forwardly of the second set on the lower front portion of the carriage provide a bearing action for the carriage when pulled in the opposite direction.

The invention possesses many other advantages and has other purposes which may be made more clearly from a consideration of the forms in which it may be embodied. These forms are shown in the drawings accompanying and forming and part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
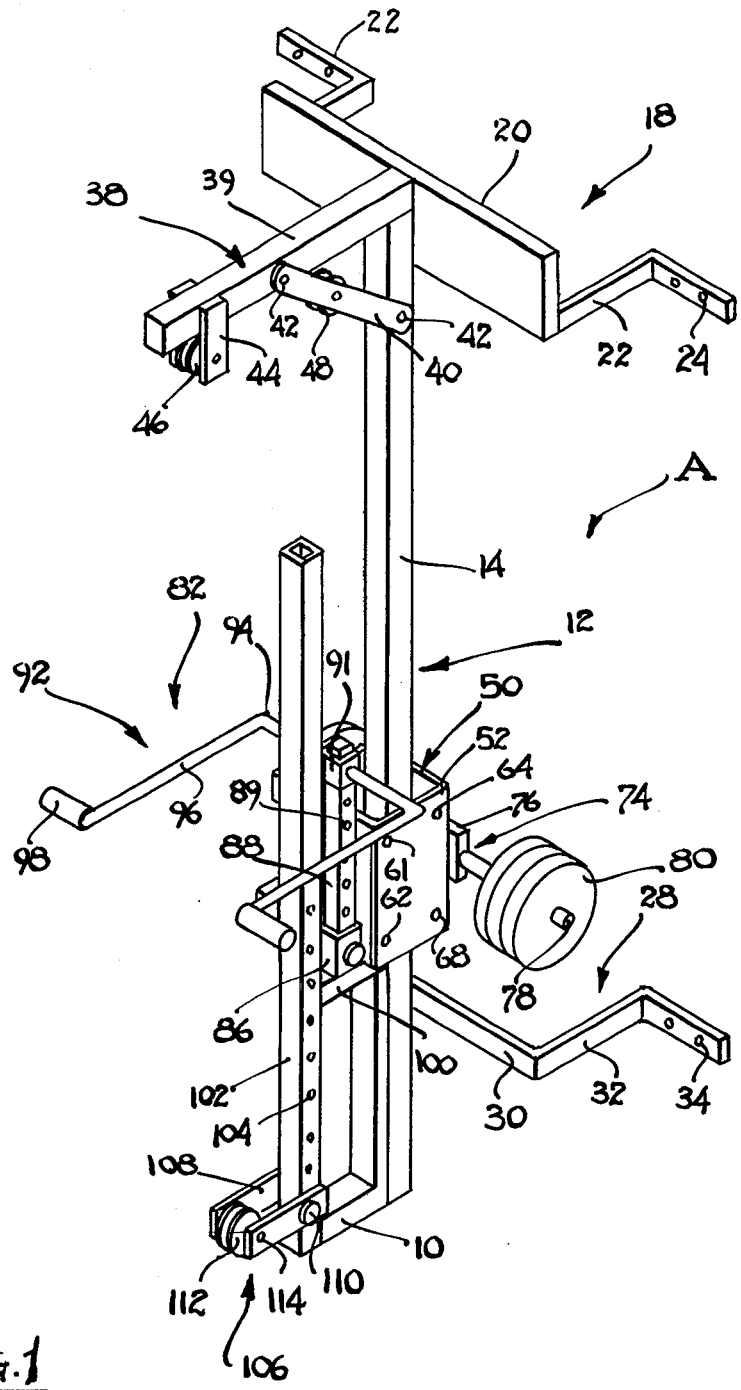
Figure 2:
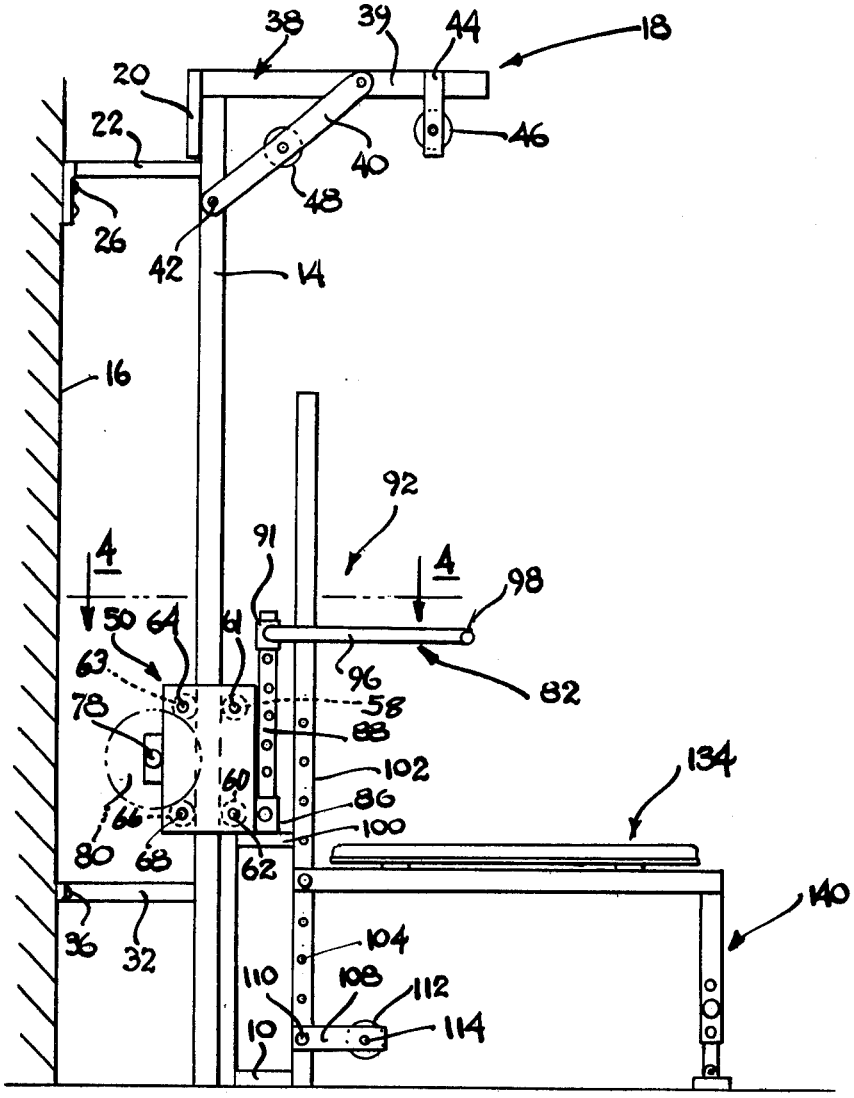
Figure 3:
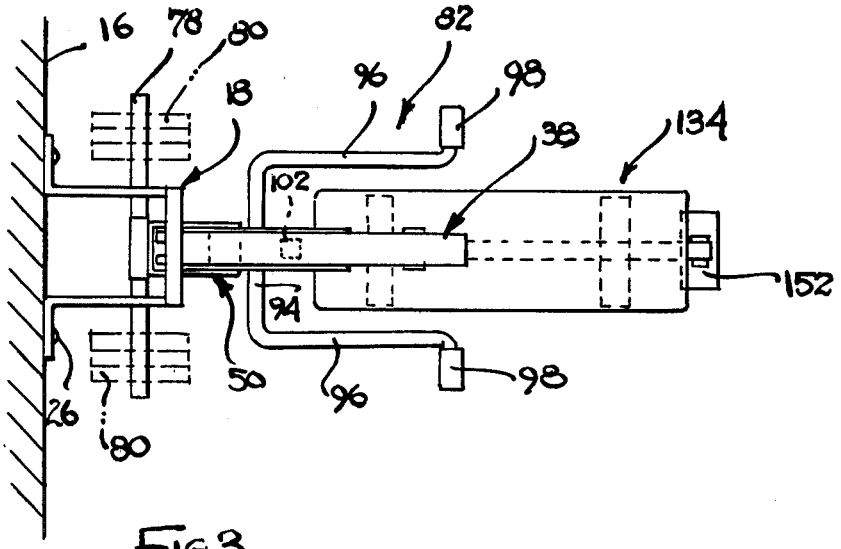
Figure 4:
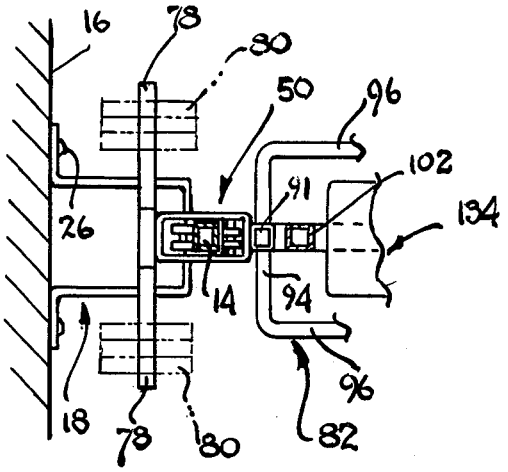
Figure 5:
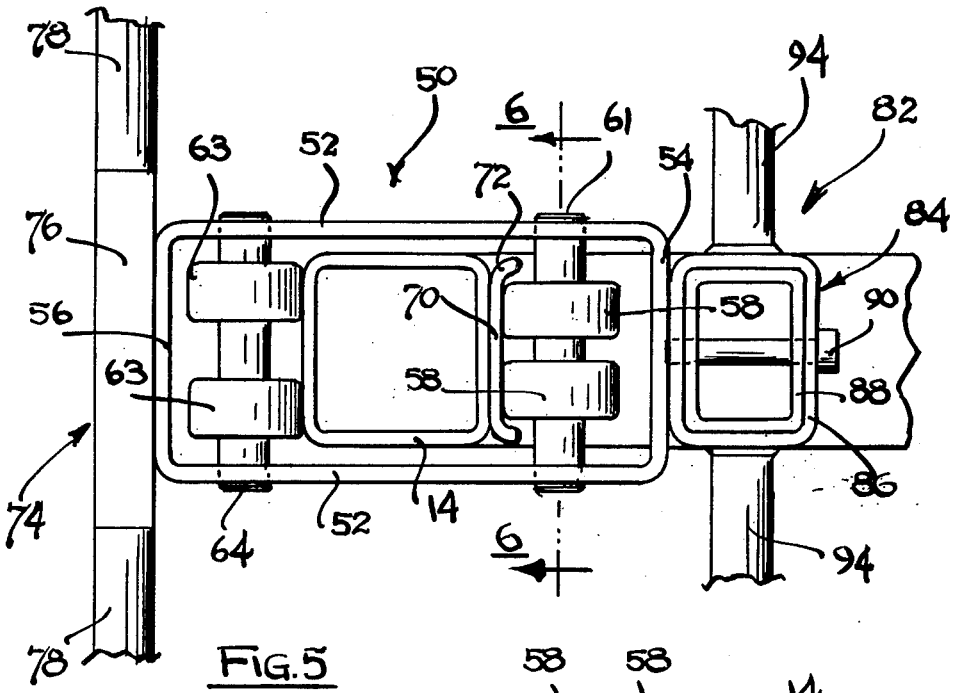
Figure 6:
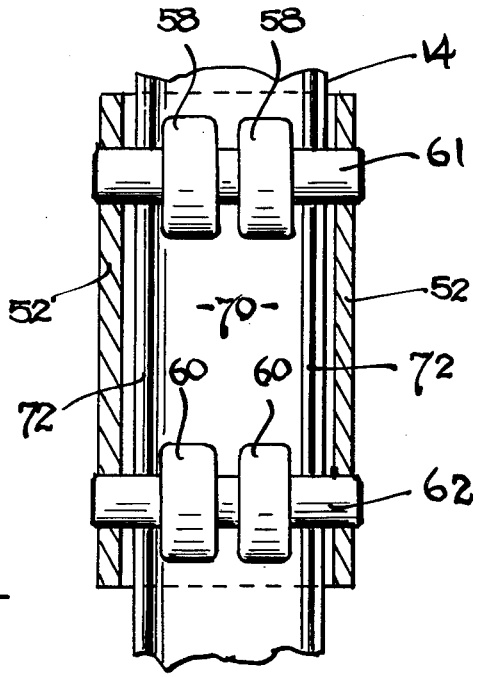
Figure 7:
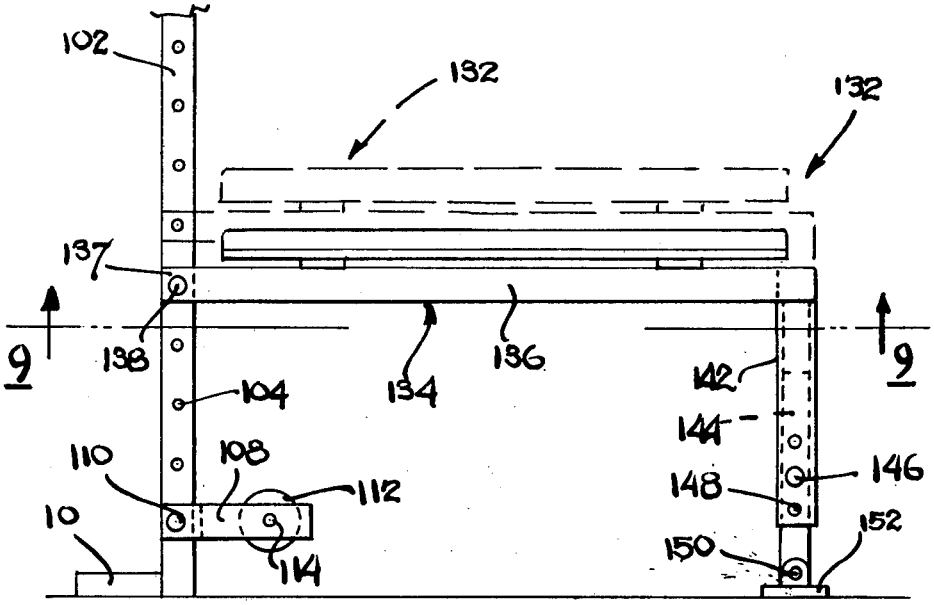
Figure 9:
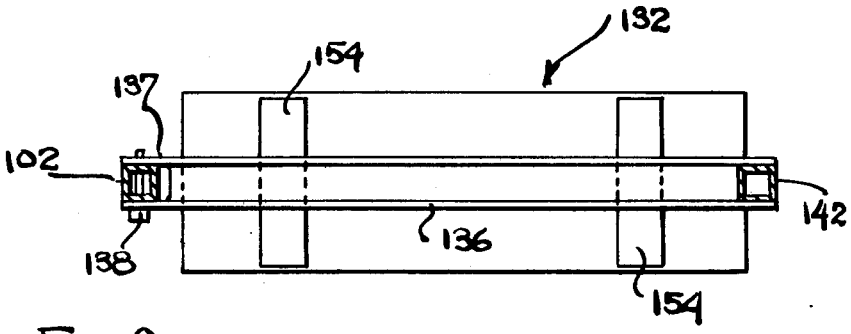
Figure 8:
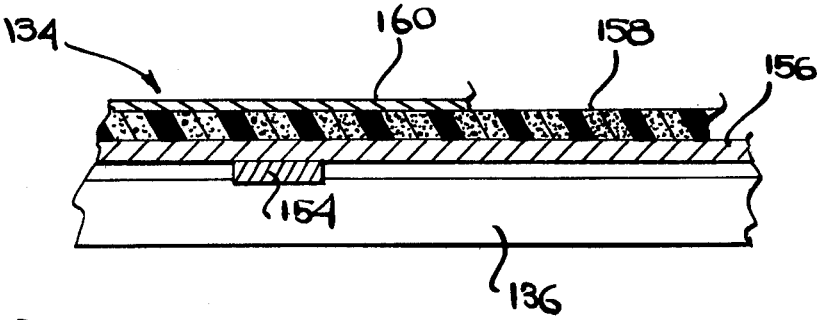
Figure 10:
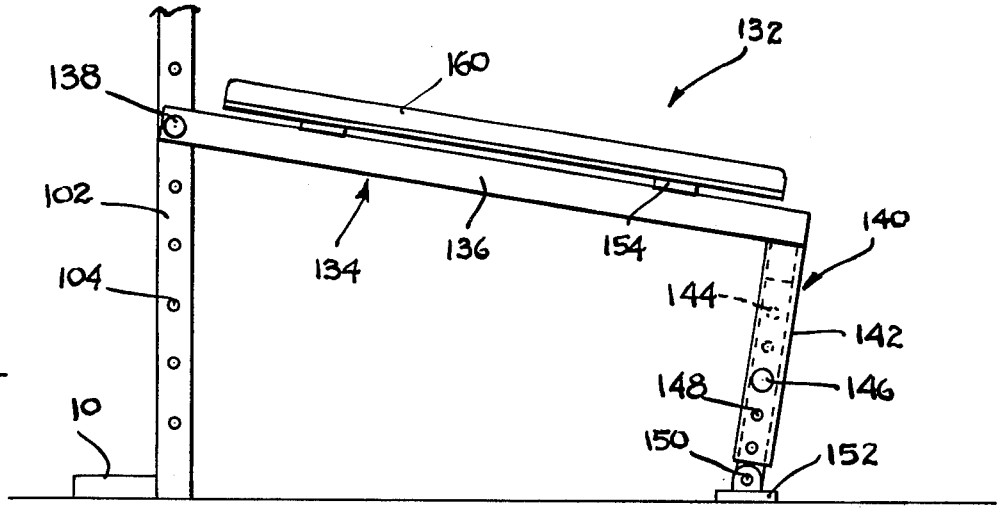
Figure 11:
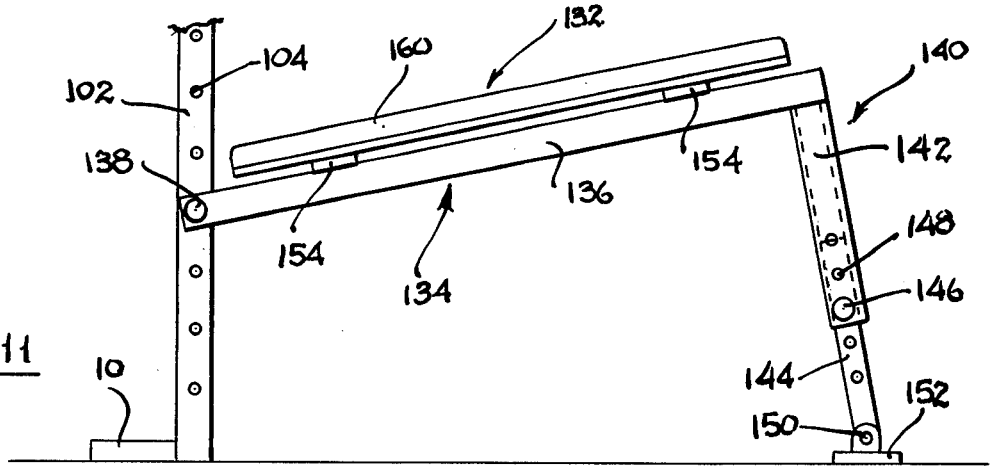
Figure 12:
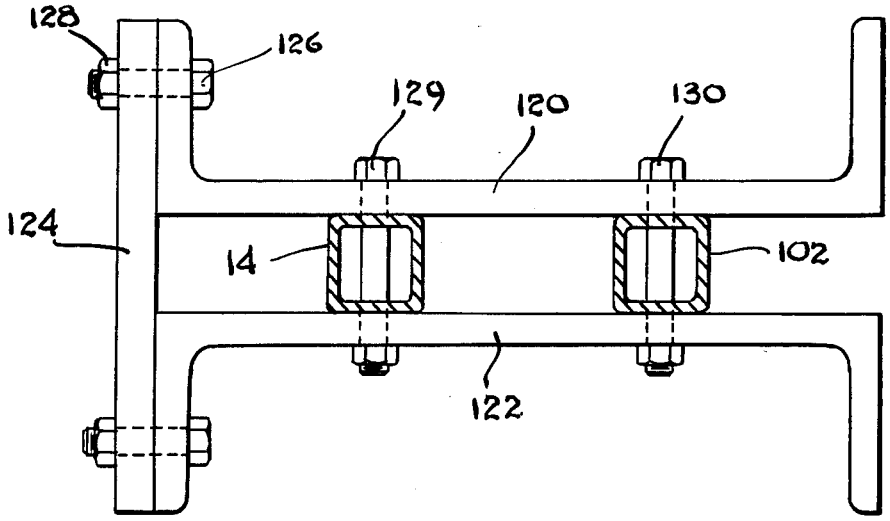
Figure 13:
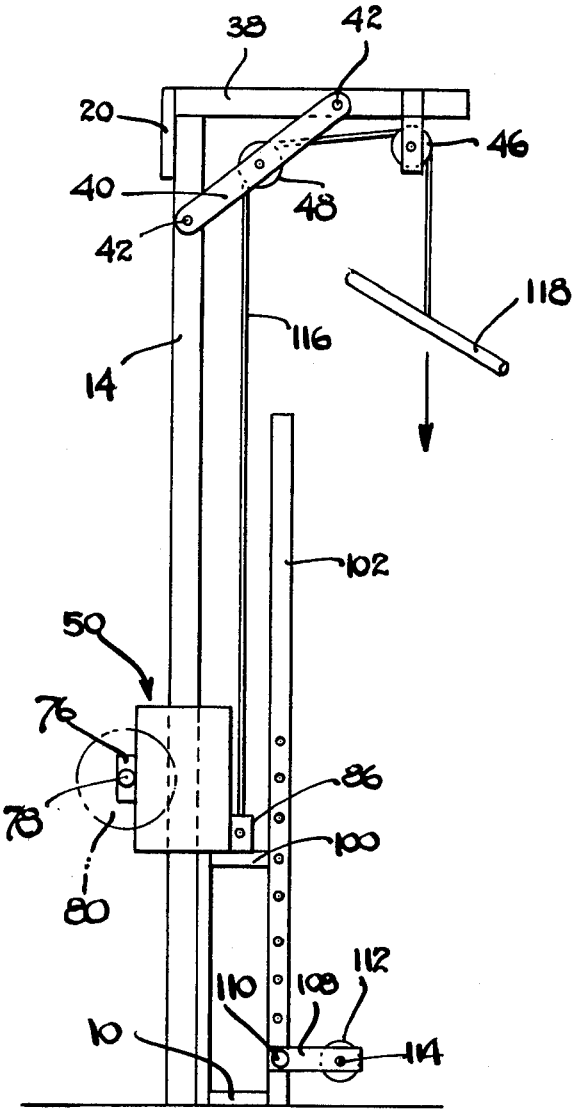
Figure 14:
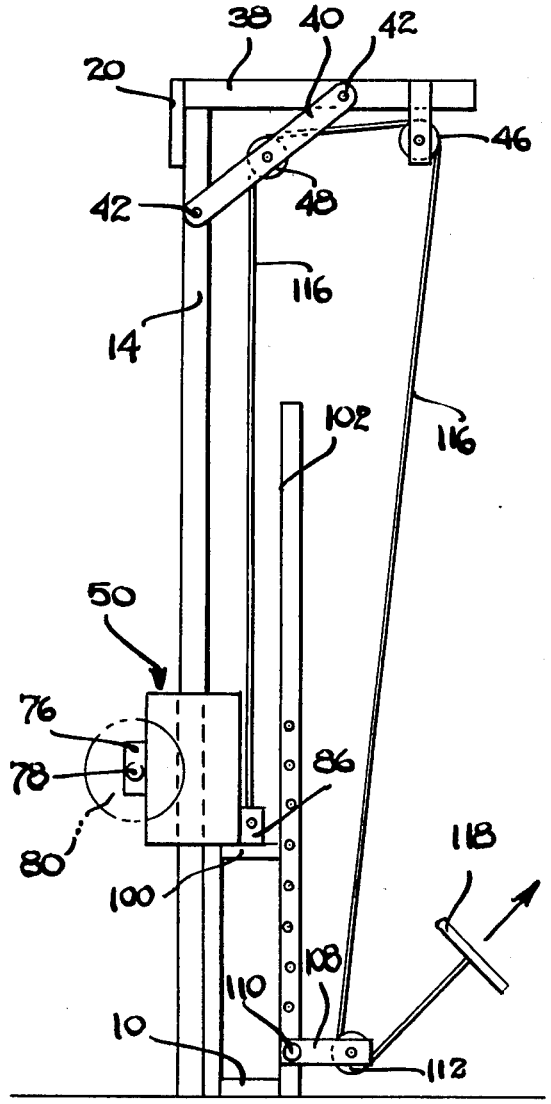

Having thus described the invention in general terms, reference will now be made to the accompanying drawings (six sheets) in which:

FIG. 1 is a perspective view of a weight lifting body exercising apparatus constructed in accordance with and embodying the present invention;

FIG. 2 is a side elevational view of the body exercising apparatus of the present invention;

FIG. 3 is a top plan view of the body exercising apparatus and showing attachment to a vertically disposed supporting surface;

FIG. 4 is a horizontal sectional view taken along line 4—4 of FIG. 2;

FIG. 5 is an enlarged top plan view looking into the carriage and showing a portion of the rollers for supporting the carriage on the upstanding structure;

FIG. 6 is a vertical sectional view taken along line 6—6 of FIG. 5 and rotated 90 degrees in counter-clockwise direction;

FIG. 7 is a fragmentary side elevational view, and showing a body supporting bench for removable attachment to the main frame and forming part of the body exercising apparatus of the present invention;

FIG. 8 is a vertical sectional view showing a portion of the construction of the body supporting bench;

FIG. 9 is a bottom plan view taken essentially along the plane of line 9—9 of FIG. 7;

FIGS. 10 and 11 are side elevational views, partially broken away, and showing two different positions of the body supporting bench when removably attached to the upstanding frame;

FIG. 12 is a horizontal sectional view showing a portion of a base frame for mounting the upstanding structure and stabilizing the same;

FIG. 13 is a schematic side elevational view showing one arrangement in which the body exercising apparatus can be used to perform certain exercises; and FIG. 14 is a schematic side elevational view, somewhat similar to FIG. 13, and showing a different arrangement for performing certain weight lifting exercises.

DETAILED DESCRIPTION OF PREFERRED EMBODIMENTS

Referring now in more detail and by reference characters to the drawings which illustrate practical embodiments of the present invention, A designate a weight lifting body exercising apparatus comprising a base frame, such as a base plate 10 and an upstanding main frame structure 12. By reference to FIGS. 1–4, it can be observed that the upstanding frame structure 12 is essentially comprised of a single pole-like member 14 and which is, in essence, the main and essentially sole component of the upstanding frame structure 12. This pole-like member 14 may be in the form of a beam, such as a tubular beam.

In this embodiment of the invention, the apparatus A may be secured to a vertically disposed wall or other vertical supporting surface 16. For this purpose, an upper attachment means, in the form of an upper attachment bracket 18 is provided. This bracket 18 comprises a mounting plate 20 which is secured to the upper end of the pole-like member 14 and a pair of integrally formed L-shaped angles 22 at opposite sides thereof. These angles 22 are provided with apertures 24 to receive conventional fasteners 26, such as screws, bolts or the like, to thereby secure the apparatus to the wall 16.

The apparatus A is also provided with a lower fastening means, in the form of a lower attachment bracket 28 which also comprises a cross-bar 30 and a pair of integrally formed L-shaped angles or so-called bracket portions 32. In this case, the bracket portions 32 are similarly provided with apertures 34 in order to receive conventional fasteners 36, in the manner as illustrated in FIGS. 1–4 of the drawings.

The apparatus A is also provided with an upper frame 38 in the form of an outwardly extending horizontally disposed beam 39. A pair of diagonally located braces 40 extend between and are secured to the upper frame 38 and the single upstanding pole-like member 14 by means of bolts 42. Carried by the upper frame 38 at its outer end is a pair of vertically disclosed flange plates 44 for retaining a cable receiving pulley 46 for reasons which will presently more fully appear.

Also mounted on and located between the pair of spaced apart braces 40 is a similar pulley 48 for removably receiving a cable in a manner as hereinafter described in more detail.

The upper frame 38 and base frame 10 can be secured to the main upstanding frame 12 by any conventional attachment means, as for example, bolts, screws, or the like. Further these members may be welded together. The major structural members which form the upstanding frame and upper frame and base frame, as well as the other components of the exercising apparatus may be formed of a variety of structural materials, as for example, wood, although various metals, such as aluminimum, steel and the like, may be employed. In addition to the foregoing, various reinforced plastic composite materials, such as fiberglass-epoxy resin composites and the like, may also be employed.

The means employed for securing the various members together will depend upon the materials of construction which are employed. The various components forming part of the weight lifting exercising apparatus should be capable of being easily assembled and disassembled. Furthermore, due to the fact that the main structure is comprised of an upper frame and main frame and base frame, or only three major components, they can be very easily connected to one other. Moreover, the wall mounting brackets 18 and 28 are also adapted for easy attachment to the rear surface of the main upstanding frame structure 12 in the manner as illustrated.

Provided for vertically shiftable movement along the single upstanding pole-like member 14 is a carriage 50. The carriage 50 generally comprises a box-like structure which is effectively a tubular structure as more fully illustrated in FIG. 5 of the drawings. In this respect, the various members forming part of the frame, such as the upper frame 38, the main frame 12 and base frame 10, are also tubular members. The carriage 50 is constructed of a larger tubular size standard welded product, or standard metal formed product.

The carriage 50 is therefore preferably comprised of a pair of side walls 52 connected by a front wall 54 and a rear wall 56. The carriage is mounted on the single upstanding pole-like member through a unique roller arrangement which comprises a pair of upper forwardly presented rollers 58 and a pair of lower forwardly presented rollers 60 and which are respectively mounted on roller shafts 61 and 62. These roller shafts 61 and 62 are journalled in the side walls 52 of the carriage 50, as more fully illustrated in FIGS. 5 and 6 of the drawings. In like manner, the carriage is also shiftable through an upper pair of rearwardly located rollers 63 mounted on a roller shaft 64 and a lower pair of rearwardly located rollers 66 which are mounted on a roller shaft 68. Again, the roller shafts 64 and 68 are journalled in the side walls 52 of the carriage 50.

By further reference to FIG. 5, it can be observed that the forwardly disposed rollers 58 are spaced closer toward one another than are the upper rearwardly located rollers 63. Furthermore, the upper pair of front rollers 58 is generally in the same horizontal plane as the upper pair of rear rollers 63 and the lower pair of front rollers 60 is generally in the same horizontal plane as the lower pair of rear rollers 66.

The rear rollers bear against the rearwardly presented surface of the single upstanding pole-like member 14 and are close to the opposite lateral sides thereof. The front rollers are spaced somewhat closer together, as aforesaid, and ride within a guide 70 welded or otherwise rigidly secured to the front surface of the single upstanding pole-like member. This guide 70 is preferably comprised of a flat plate with curled edges 72 on opposite lateral sides as illustrated. The rollers 58 ride close to the edges of the plate where the plate merges into the curled edges 72. This construction has been found to be very effective in supporting the carriage 50 on the single upstanding pole-like member 14. Further, this arrangement has been found to be sufficient for completely enabling the carriage to be stabilized and without binding against the polelike member 14 or any other portion of the apparatus A during vertical shifting movement.

The upper front rollers 58 and the lower rear rollers 66 provide the primary support of bearing action for the carriage 50 when a user of the apparatus attempts to lift upwardly on the carriage 50. It can be observed that the carriage 50 would be canted slightly such that the rollers 58 and 66 are biased into the pole-like member 14. When the load of weights on the carriage 50 causes the same to move downwardly, by a force of gravity, the primary bearing action is still provided by these same pairs of rollers 58 and 66. However, if a user of the apparatus attempted to pull downwardly on the carriage the primary bearing action would be shifted to the lower front rollers 60 and the upper rear rollers 63. Thus, the user of the apparatus is permitted to lift weights mounted on the carriage (in a manner as hereinafter described in more detail) and with little or no interference created by frictional forces or binding effects.

This construction has also been found to be highly effective in that it permits a carriage to be mounted for vertically shiftable movement on only a single vertically disposed pole or beam. Hence, the apparatus itself is quite simple, not only in the manufacture thereof, but in the assembly as well. Further, due to the fact that it is not necessary to have a complex up-standing tower-like structure, the cost of manufacture is substantially reduced.

Mounted on the rear surface of the carriage 50 is a weight retaining means 74 comprising a cross bar 76 welded or otherwise rigidly secured to the rear wall 56 of the carriage 50. Extending from and retained by the cross bar 76 are a pair of oppositely disposed outwardly extending rods 78, the latter of which are adapted to receive bar-bell type weight discs 80, in the manner as illustrated in FIG. 1 of the drawings. Thus, it can be observed, that the user of the apparatus can removably dispose a desired number of bar-bell type weight discs 80 and in a selected amount of weight on the outwardly extending rods 78. If desired, clamps may be provided at the ends of each of the oppositely disposed outwardly extending rods 78 for retaining the bar-bell type weight discs on the rod 78, although it has been found in actual pratice that this is not necessary.

An adjustably positionable handle means 82 is also mounted on the carriage 50 for engagement by the hands of a user of the apparatus. The adjustably positionable handle means 82 comprises an adjustable positioning means 84 which includes a tubular collar 86 welded, or otherwise rigidly secured to the forwardly presented wall 54 of the carriage 50. This collar 86 receives a vertically shiftable and positionable height tube 88 which may be vertically positionable within the collar 86 to a desired height. The height tube 88 is provided with a series of vertically disposed apertures 89 alignable with like apertures in the collar 86. Thus, the height tube may be removably retained at a desired height by means of one or more removable bolts 90, in the manner as more fully illustrated in FIG. 5 of the drawings. In this way, the height tube 88 may be vertically shiftable within the sleeve 86 to a desired vertical position and retained thereby by means of the bolt 90 being inserted in aligned apertures therein. This bolt 90 may also adopt the form of a removable locking pin.

Mounted on the upper end of the height tube 88 is another collar or sleeve 91 which carries a handle 92 forming part of the adjustably positionable handle means. This collar 91 may be rigidly secured to the height tube 88 or in the preferred embodiment it may be adjustably positionable on the tube 88. Positioning of the height tube 88 in a number of different vertical positions can be achieved by the use of removable bolts insertable into aligned apertures on the sleeve 91 and the height tube 88.

The adjustably positionable handle mechanism 82 also comprises the handle 92 as aforesaid which comprises a pair of handle members 94 extending outwardly from opposite sides of the collar 91. The handle members 94 are preferably integrally formed with forwardly struck arms 96 and each of which are provided with longitudinal hand portions or hand grips 98, much in the manner as illustrated in FIG. 1 of the drawings.

Two different forms of adjustable positioning are provided in accordance with the apparatus of the present invention. The first adjustable position is enabled by proper positioning the height tube 88 within the sleeve 86 and the second of the positionings is enabled by controlling the position of the collar 91 on the height tube 88.

A plate 100 is welded or otherwise rigidly secured to the pole-like members 14 serves as a lower stop for the carriage 50. Thus, the lowermost limit of movement of the carriage 50 is controlled by this plate 100.

The versatility of the adjustable handle mechanism is effective in the apparatus of the present invention in that it enables a wide degree of handle positioning to be achieved in order to permit the user to accomplish a large number of exercises. Thus, by properly locating the handle mechanism in a desired position, it permits the user to assume various positions, such as a kneeling position, a standing position or the like, in order to perform the desired weight lifting exercise.

Bolted or otherwise rigidly secured to the forward end of the base frame 10 is an upstanding support post 102 having a plurality of vertically spaced apart pairs of apertures 104 on each of the opposite sides of the post 102. In this case, the post 102 is also tubular so as to be capable of receiving a pin in any of the apertures 104. Moreover, the post 102 is preferably of a tubular construction in the same manner as each of the other members forming part of the frame portions of the apparatus A of the present invention. While the post 102 is upstanding, the only part of the main frame which is deemed to be an upstanding pole like member is that member 14. The post 102 is essentially provided in order to maintain some special relationship or distance between the user of the apparatus and the main upstanding frame structure 12. The post 102 also serves as an attachment bracket. Thus, while the post 102 may be considered to be part of the main frame or frame means it is not deemed to be an upstanding polelike member, or a rigid upstanding frame member, but rather a spacer or bracket.

The tube 102 also accomplishes the auxiliary purpose of retaining a lower pulley mechanism 106. The pulley mechanism 106 comprises a pair of spaced apart plates 108 which may form part of a bracket and which are secured in any of a number of positions on the upstanding tubular support posts 102 by means of a removable bolt 110. Moreover, the plates 108 are adapted at their outer ends to carry a cable receiving pulley 112 which is journaled in the plates 108 by means of a pulley shaft 114. It should be understood that the plates 108 and hence the pulley 112 could be positioned near the lower portion of the apparatus A by adjustably positioning the plates through the use of the bolt 110.

In accordance with the above outlined construction, it can be observed that there are at least three pulleys on the apparatus A capable of receiving a cable which, in turn, is connected to a source of weight, as for example, the weights 80. The first of the pulleys is that pulley designated by reference numeral 48 which is located above the normal height of the user of the apparatus and rearwardly of the user of the apparatus in normal operation. The second of the pulleys is the pulley 46 located forwardly of the pulley 48 and essentially in the same horizontal plane but which may be disposed vertically above the user of the apparatus in normal operation. The third of the pulleys is that pulley designated by reference numeral 112 which is located at the lowermost portion of the apparatus and normally below the hands of the user of the apparatus.

A cable 116 may be trained around the pulleys 46, 48 and 112, as more fully illustrated in FIGS. 13 and 14 of the drawings. This same cable 116 may also be trained about only one, or two or more of the pulleys, in a plurality of cable arrangements, a wide variety of arrangements utilizing only one, or two or more of the pulleys. It is important that the cable be attached to, or operatively attached to, the carriage 50 so as to enable the user of the apparatus to exert a force against the weights disposed on the rods 78 and thereby lift the weights imposed on the carriage 50.

In the embodiments of the apparatus as illustrated in FIGS. 13 and 14, the carriage is not used directly to carry the handle mechanism 82. In place of the handle mechanism 82, a handle bar 118 is secured to one end of the cable 116 and adapted to be engaged by the user of the apparatus. In this case, the handle 118 is typically above the user of the apparatus so that he can exert a downward force by pulling downwardly on the same and thereby lift the carriage 50 and hence the weights 80 disposed thereon. In this particular arrangement, the cable 116 is trained around the upper pulley 46 and the upper rearwardly disposed pulley 48.

In the embodiment of the invention as illustrated in FIG. 14, the handle mechanism 118 is disposed at a normal elevation lower than the arms and shoulders of the user of the apparatus. In this embodiment, the cable 116 is trained about the pulley 48, the pulley 46, as well as the lower pulley 112. Thus, the user of the apparatus would exert an upward force although the amount of force required might be less due to the particular arrangement employed. It should be understood that a wide variety of pulley arrangements could be used so as to train the cable 116 in a desired path, and thereby achieve the necessary mechanical advantage for the user of the apparatus to exert a force against the weights imposed on the carriage 50.

As indicated previously, the weight lifting body exercising apparatus A is adapted for disposition on a floor or other supporting surface and is normally secured to a wall or similar vertically disposed supporting surface. It should also be understood that it is possible to provide an apparatus in accordance with the present invention which does not necessarily require the upper bracket 18 and the lower bracket 28. Thus, for example, as seen in FIG. 12, the vertically disposed pole-like member 14 as well as the upstanding post 102 may be secured to pairs of oppositely disposed somewhat U-shaped floor engaging brackets 120 and 122 which are each bolted to a rear mounting plate 124 by means of bolts 126 and nuts 128. The single upstanding pole-like member 14 as well as the post 102 are secured to the brackets 120 and 122 by means of removable bolts 129 and 130, respectively. In this case, it can be observed that it is possible to construct an apparatus which does not necessarily require a wall mounting, that is, mounted against a vertically disposed support structure. In other words, the apparatus could be constructed so that it is capable of operating as a free-standing unit.

The weight lifting body exercising apparatus A of the present invention can also be used with a body supporting bench assembly 132, more fully illustrated in FIGS. 7–11 of the drawings. The body supporting bench assembly 132 generally comprises a main frame 134 which is comprised of a single forwardly extending main beam 136 pivotally secured to the upstanding post 102 by means of a removable bolt 138 which is capable of being removably disposed in any of the plurality of apertures 104 formed in the upright post 102. In this respect, even though the post 102 supports one end of the bench assembly 132, it does not form part of the main frame 134 although it could actually be integrated therein.

The main beam 136 of the bench assembly 132 preferably is an inverted U-shaped channel which is provided at its rearward end with a pair of rearwardly extending ears 137 having apertures capable of being aligned with the apertures 104 in the upright post 102. Thus, mechanical fasteners, such as pins or the aforesaid bolt 138 can be inserted in the aligned apertures in order to support the bench 132 in a desired position.

The body supporting bench 132 also includes at least one downwardly extending leg mechanism 140 which is comprised of an outer tubular leg 142 and an inner vertically positionable leg tube 144. In this case, the inner leg tube 144 is capable of being vertically positioned within the outer leg tube 142 and retained in certain desired positions by means of a bolt 146. Thus, by reference to FIG. 10, it can be observed that the bolt 146 is capable of being positioned in any of a number of apertures 148 located within the outer leg 142 and alignable with any of the aligned apertures in the leg tube 144. In this way, the inner leg tube 144 is capable of being positioned relative to the outer leg 142 in a wide variety of positions so as to effect the overall angular relationship between the body supporting bench 132 and the upstanding post 102. At its lower end, the outer leg tube 142 is provided with a hinge pin 150 and which carries a floor engaging plate 152 so as to engage the floor or other supporting surface.

The beam 136, itself, may be a U-shaped channel, as aforesaid, or otherwise, it may be constructed of a pair of spaced apart bars 136 which are welded together by means of a pair of transversely extending pad supporting plates 154 on their upper surface. These pad supporting plates 154 may be welded or rigidly secured to the beam 136. Moreover, the pad supporting plates are designed to receive and carry a wooden plank 156 having a somewhat resilient pad-like material, such as a urethane foam layer 158 on its upper surface and which is covered by an outer vinyl plastic layer 160.

The bench 132 may be optionally used, depending upon the type of exercise to be performed. Moreover, the height of the bench can be changed by merely extending the telescopically located leg tube 144 and retaining the same in the desired position by means of the bolts 146. Furthermore, by properly positioning the left-hand end of the bench, it is possible to obtain the desired angle. For example, the bench may be canted so that the foot-end is lower than the head-end, as illustrated in FIG. 10, or it may be canted so that the head-end is lower than the foot-end, as illustrated in FIG. 11.

When not using the body supporting bench, the cable 116 can be selectively trained about any one or more of the pulleys in a desired configuration. FIG. 13 illustrates one such configuration in which the user of the apparatus would engage the handbar 118 and pull downwardly on the same. FIG. 14 illustrates another arrangement in which the user of the apparatus would engage the handbar and effectively pull upwardly on the same. Thus, it can be seen that it is possible to eliminate the handle mechanism 82 and merely use a handbar, as aforesaid, in a certain number of the exercises to be performed.

Thus, there has been illustrated and described a weight lifting exercising apparatus which includes a frame having a single upstanding pole-like member and a carriage vertically shiftable thereon and with a body bench assembly provided for removable attachment thereto and with a plurality of pulleys selectively located so that a cable can be trained about one or more of the pulleys in desired configurations to enable performance of a large number of exercises. This apparatus accordingly fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which may become apparent to those skilled in the art, after considering this specification and the accompanying drawings, are deemed to be covered by the invention which is limited only by the following claims.

Having thus described my invention, with desire to claim and secure by letters patent is:

1. An exercising apparatus comprising:

(a) a main frame having as an upstanding generally vertically disposed structure, a single upstanding pole-like member, (b) means associated with said pole-like member for mounting said pole-like member and thereby stabilizing same against forces which would cause movement away from a vertical direction, (c) a carriage of relatively small dimension in the vertical direction compared to its distance of movement and being vertically shiftable on said pole-like member, (d) a generally horizontally disposed weight retaining bar-bell member operatively mounted on said carriage for receiving bar-bell weight discs such that a number of different bar-bell weight discs and of differing weights can be removeably disposed on said weight retaining member, (e) engagable means operatively mounted on said carriage in approximately the same horizontal region as the bar-bell member and on opposite sides of the carriage for permitting the user of the apparatus to use the engagable means to cause application of a force to the carriage against that of the weight discs on the weight retaining means, (f) a first pair of rollers located between said pole-like member and said carriage and on the same side of said carriage as said engagable means and which supports said carriage in vertical shift movement, (g) a second pair of rollers located between said pole-like member and said carriage and which supports said carriage in vertical shiftable movement, said second pair of rollers being located below and on the opposite side of said carriage with respect to said first set of rollers, said first and second pairs of rollers being the primary bearing means between said carriage and said pole-like member, and (h) a guide track on one flat surface of said pole-like member and that one pair of said first or second pairs of rollers move in said guide track.

2. The exercising apparatus of claim 1 further characterized in that the means associated with the pole-like member for stabilizing same is at least one bracket for mounting said member to a vertically disposed supporting structure.

3. The exercising apparatus of claim 1 further characterized in that the means associated with the pole-like member for stabilizing same is a base frame to which said polelike member is rigidly secured.

4. The exercising apparatus of claim 1 further characterized in that said engagable means is a hand grip engagable means.

5. The exercising apparatus of claim 4 further characterized in that said engagable means is mounted on said carriage for movement therewith.

6. The exercising apparatus of claim 5 further characterized in that said engagable means is mounted on said carriage through an adjustable positioning means which permits the position of the hand grip engagable means to be adjustably positioned with respect to said carriage.

7. The exercising apparatus of claim 6 further characterized in that said adjustable positioning means comprises an outer sleeve mounted on said carriage, a pole vertically shiftable within said sleeve, and pin means to retain said pole in a desired selected position with respect to said sleeve.

8. The exercising apparatus of claim 1 further characterized in that said weight retaining bar-bell member comprises a pair of generally horizontally disposed weight receiving bar-bell sections extending laterally outwardly from said single pole-like member which are adapted to receive conventional barbell type weights.

9. The exercising apparatus of claim 1 further characterized in that each of the rollers of the first pair are spaced closer to each other than the rollers of the second pair.

10. The exercising apparatus of claim 1 further characterized in that:

(a) a third pair of horizontally spaced apart rollers is located on the same side of said carriage as said second pair and is opposite said first pair, and (b) a fourth pair of horizontally spaced apart rollers is located on the same side of said carriage as said first pair and opposite said second pair.

11. The exercising apparatus of claim 10 further characterized in that each of said rollers in said first and fourth pairs of rollers are located closer to each other than the rollers in said second and third pairs.

12. The exercising apparatus of claim 11 further characterized in that arcuate end portions are formed on opposite sides of said guide track and form a channel arrangement, said first and fourth pairs of rollers ride in said channel arrangement on said pole-like member closer to the arcuate end portions.

13. An exercising apparatus comprising:

(a) a main frame having only a single upstanding pole-like member, (b) means associated with said pole-like member for mounting said pole-like member and thereby stabilizing same against forces which would cause movement away from a vertical direction, (c) a carriage vertically shiftable on said pole-like member, (d) a guide track on one flat surface of said pole-like member, (e) a first pair of horizontally spaced apart rollers located between the guide track on said pole-like member and said carriage which support said carriage in vertical shiftable movement, (f) a second pair of horizontally spaced apart rollers located between said carriage and a flat surface of said pole-like member opposite said first named flat surface and which supports said carriage in vertical shiftable movement, said second pair of rollers being located below and on opposite sides of said carriage with respect to said first set of rollers, each of the rollers of said first pair of rollers being spaced closer to each other than the rollers of the second pair said first and second pairs of rollers being the primary bearing means between said carriage and said pole-like member.

14. The exercising apparatus of claim 13 further characterized in that weight retaining means is operatively mounted on said carriage in such manner that a user must apply a force in a direction opposite that of the weight retaining means to exercise.

15. The exercising apparatus of claim 14 further characterized in that said weight retaining means comprises a pair of poles extending laterally outwardly from said single pole-like member which are adapted to receive conventional bar-bell type weights.

16. The exercising apparatus of claim 13 further characterized in that:

(a) a third pair of horizontally spaced apart rollers is located on the same side of said carriage as said second pair and are opposite said first pair, and (b) a fourth pair of horizontally spaced apart rollers is located on the same side of said carriage as said first pair and opposite said second pair.

17. The exercising apparatus of claim 16 further characterized in that each of said rollers in said first and fourth pairs of rollers are located closer to each other than the rollers in said second and third pairs.

18. The exercising apparatus of claim 17 further characterized in that arcuate end portions are formed on opposite sides of said guide track and form a channel arrangement, said first and fourth pairs of rollers ride in said channel arrangement on said pole-like member close to the arcuate end portions.

* * * * *